US006645539B2

(12) United States Patent
Bukowski et al.

(10) Patent No.: US 6,645,539 B2
(45) Date of Patent: Nov. 11, 2003

(54) FOOD PACKAGING WITH SYSTEM FOR DISPERSION ON EDIBLE FOOD COMPONENT

(75) Inventors: Todd Michael Bukowski, Oak Park, IL (US); Neil Joseph Enciso, Chicago, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 298 days.

(21) Appl. No.: 09/897,588

(22) Filed: Jul. 2, 2001

(65) Prior Publication Data

US 2003/0003200 A1 Jan. 2, 2003

(51) Int. Cl.[7] ..... B65B 29/08

(52) U.S. Cl. ..... 426/120; 426/107; 426/113; 426/115; 426/234; 426/243

(58) Field of Search ..... 426/107, 113, 426/115, 120, 234, 243, 112

(56) References Cited

U.S. PATENT DOCUMENTS

| | | | | | |
|---|---|---|---|---|---|
| 2,287,610 | A | | 6/1942 | Guidry | 229/15 |
| 2,714,070 | A | | 7/1955 | Welch | |
| 2,739,751 | A | | 3/1956 | Bailey | 229/15 |
| 2,965,501 | A | | 12/1960 | Harriss | |
| 3,796,813 | A | | 3/1974 | Kurland | |
| 3,819,080 | A | * | 6/1974 | Bird | 426/112 |
| 4,018,904 | A | | 4/1977 | Muraoka | 426/115 |
| 4,133,896 | A | | 1/1979 | Standing et al. | 426/107 |
| 4,166,208 | A | * | 8/1979 | Martel | 426/243 |
| 4,233,325 | A | | 11/1980 | Slangan et al. | 426/107 |
| 4,367,243 | A | | 1/1983 | Brummett et al. | 426/303 |
| 4,388,334 | A | | 6/1983 | Deveaux | 426/112 |
| 4,596,713 | A | | 6/1986 | Burdette | 426/107 |
| 4,794,008 | A | | 12/1988 | Schmidt et al. | 426/234 |
| 4,803,088 | A | | 2/1989 | Yamamoto et al. | 426/107 |
| 4,806,371 | A | * | 2/1989 | Mendenhall | 426/107 |
| 4,820,533 | A | | 4/1989 | Seaborne et al. | 426/76 |
| 4,874,618 | A | | 10/1989 | Seaborne et al. | 426/76 |
| 4,948,605 | A | | 8/1990 | Lambert, Jr. | 426/107 |
| 5,045,333 | A | | 9/1991 | Petrofsky et al. | 426/394 |
| 5,055,312 | A | | 10/1991 | Hildebrand | 426/107 |
| 5,064,980 | A | | 11/1991 | Grossman et al. | 219/10.55 E |
| 5,140,121 | A | | 8/1992 | Pesheck et al. | 219/10.55 E |
| 5,312,014 | A | | 5/1994 | Hamlin | 220/703 |
| 5,676,244 | A | * | 10/1997 | Green et al. | 426/120 |
| 5,681,602 | A | | 10/1997 | Alden et al. | 426/132 |
| 5,749,460 | A | | 5/1998 | Rice | 220/23.83 |
| 5,807,597 | A | | 9/1998 | Barnes et al. | 426/324 |
| 5,979,656 | A | * | 11/1999 | Northcott et al. | 426/115 |
| 6,116,500 | A | | 9/2000 | Cahill | 229/120.32 |
| 6,188,055 | B1 | | 2/2001 | Walters | 219/730 |
| 6,509,047 | B2 | * | 1/2003 | Edomwonyi | 426/234 |

FOREIGN PATENT DOCUMENTS

| | | | | |
|---|---|---|---|---|
| JP | 57-12228 | * | 1/1982 | 426/107 |
| JP | 57-210223 | * | 12/1982 | 426/243 |
| JP | 2-296683 | * | 12/1990 | 426/120 |
| WO | WO90/08710 | * | 8/1990 | 426/107 |

* cited by examiner

*Primary Examiner*—Steve Weinstein
(74) *Attorney, Agent, or Firm*—Fitch, Even, Tabin & Flannery

(57) ABSTRACT

A package is provided for shipping first and second food product components, and for dispensing the second food product component over the first food product component during heating. Food package includes a bowl having fluted portions cooperating with fluted portions of a cap. The cap includes a plurality of protrusions pointed toward the bowl which guide the second food product component for uniform dispersion.

16 Claims, 5 Drawing Sheets

FOOD PACKAGING WITH SYSTEM FOR DISPERSION ON EDIBLE FOOD COMPONENT

BACKGROUND OF THE INVENTION

1. Field of the Invention

The present invention pertains to the packaging of food products, and more particularly to food product packaging which aids in dispersing, on demand, a solid food component, such as a cheese sauce, onto a second food component such as vegetable chips, crisps, or the like.

2. Description of the Related Art

A wide variety of dips and sauces has been provided to complement food products such as tortilla chips, potato chips and crisps, for example. The complementary sauces and dips may be served at a variety of temperatures ranging from refrigerated temperatures to much hotter, elevated temperatures. Typically, when served at elevated temperatures, the sauce or dip is removed from a container and placed in a cooking vessel or dish for heating. Advances in packaging and serving are continually being sought.

A problem associated with multi-component food products of the type described above, in addition to the extra steps and use of dishes associated with separate heating, is the uneven dispersion of one food component over the other. For example, while a cheese sauce may be served in a cup, for use as a dip, it is becoming increasingly popular to pour a melted cheese sauce over a pile of food chips. Care must be taken to drizzle or otherwise pour the cheese sauce evenly across the mound of chips. Too often cheese sauce is concentrated in a localized position of the mounded pile of food chips. Improvements in dispersion and a reduction in the amount of attention paid to dispersion techniques is being sought.

SUMMARY OF THE INVENTION

It is an object of the invention to provide a multi-component food product in which a first solid food component is converted into liquid form for use with a second food component such as food chips or the like.

Another object of the present invention is to provide a packaging for food products of the above type which are suitable for use in microwave ovens.

Yet another object of the present invention is to provide automatic or unattended even dispersion of the liquified food product onto a second food component.

A further object of the present invention is to provide packaging of the type described above suitable for use in mass production assembly operations.

Yet another object of the present invention is to provide food packaging of the above-described type which is suitable for use with high volume gas flushing operations carried out immediately prior to sealing of the package, so as to preserve the freshness of the food components.

These and other objects of the present invention are provided in a combination of a food product and package, assembled for transport to a remote location, which comprises a bowl that has a side wall and a bottom wall which cooperate to define an interior cavity, and an upper end. A cap or lid dimensioned to close the upper end of the bowl has a central cup-like depression that receives the second food component in a solid cake form. The central portion of the lid includes a plurality of protrusions which extend into the second food product component. The cap includes a pair of diametrically opposed fluted portions disposed on either side of the central portion. The bowl defines a pair of diametrically opposed fluted portions complementarity shaped with the fluted portions of the cap so that the cap and bowl nest interfitting with the cap in both shipping and heating inverted positions. The cap in the heating position presents protrusions downwardly which extend toward the bowl interior with the outer surfaces of the protrusions guiding the second food product component for uniform distribution about the interior of the bowl.

DETAILED DESCRIPTION OF THE PREFERRED EMBODIMENTS

Turning now to the drawings, a package for a food product is generally indicated at 10. Package 10 includes a cap 12 and a cup or bowl 14. Cap 12 is moveable between a storage position illustrated in FIG. 1 and a cooking or heating position illustrated in FIG. 2. Cap 12 and bowl 14 are preferably made of plastic materials suitable for heating in a microwave oven and, like bowl 14, cap 12 is preferably made of a single integral molded construction.

Figure 4:
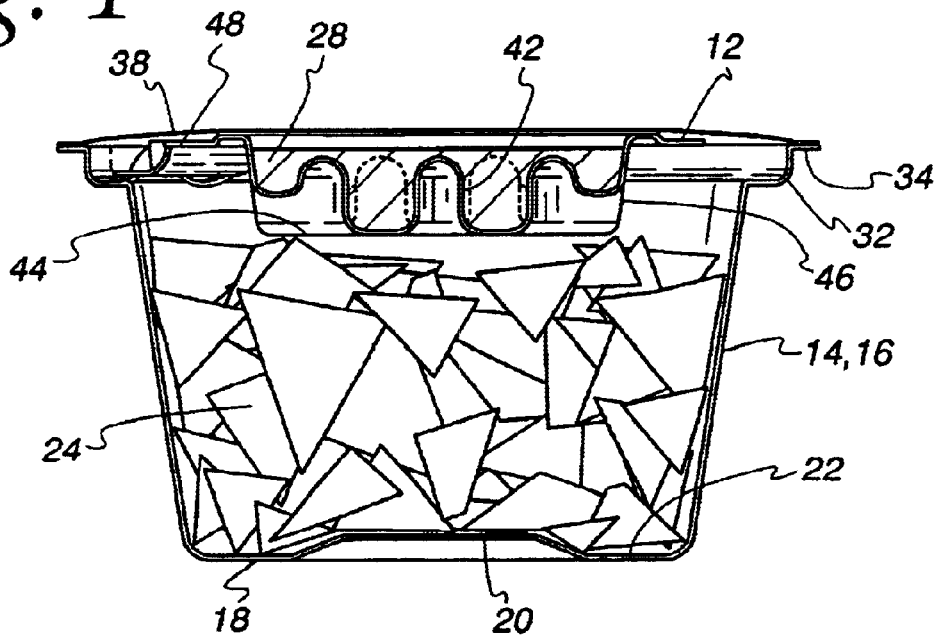
FIG. 4 is a side elevational view, shown partly broken away, of the food package prepared for shipment, and including food product components.

Referring to FIG. 4, bowl 14 includes a side wall 16 and a bottom wall 18 having a central raised portion 20 forming an outer annular recessed portion 22. FIG. 4 shows bowl 14 filled with a first food product component 24 in the form of a relatively rigid tortilla chips 24. The food product component 24 could also comprise any of a number of farinaceous foods which include, for example, grain and cereal products, such as soft and hard breads and crackers as well as vegetable products such as vegetable chips, including chips made of potato or corn.

Food product component 24 preferably has a thin, rigid or semi-rigid form, but may also be soft and pliable. The outer annular recess 22 provides a convenient collection point for a second food product component 28 carried in cap 12 in the manner shown in FIG. 4. As will be explained herein, cap 12 is inverted by a consumer to the position shown in FIGS. 2 and 6–8 and subjected to elevated temperatures which cause the second food product component 28 to disperse onto the first food product component 24. Any excess second food product component 28 not retained by the first product 24 is collected in the portions of the outer annular recesses 22 to allow a consumer to scrape second food product component from the bottom of bowl 14.

Figure 5:
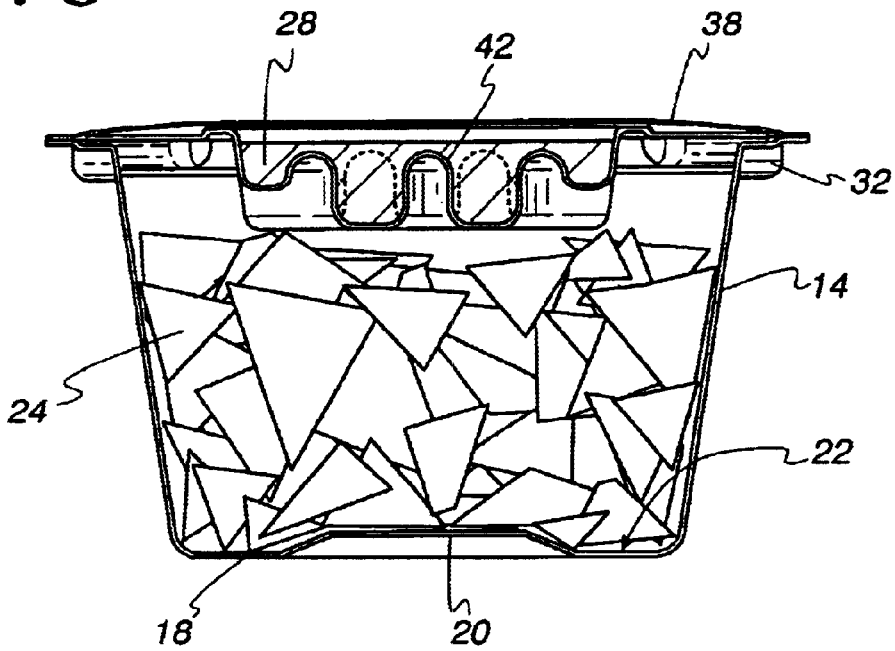
FIG. 5 is a view similar to that of FIG. 4 but showing additional portions of the food container being broken away.
Figure 6:
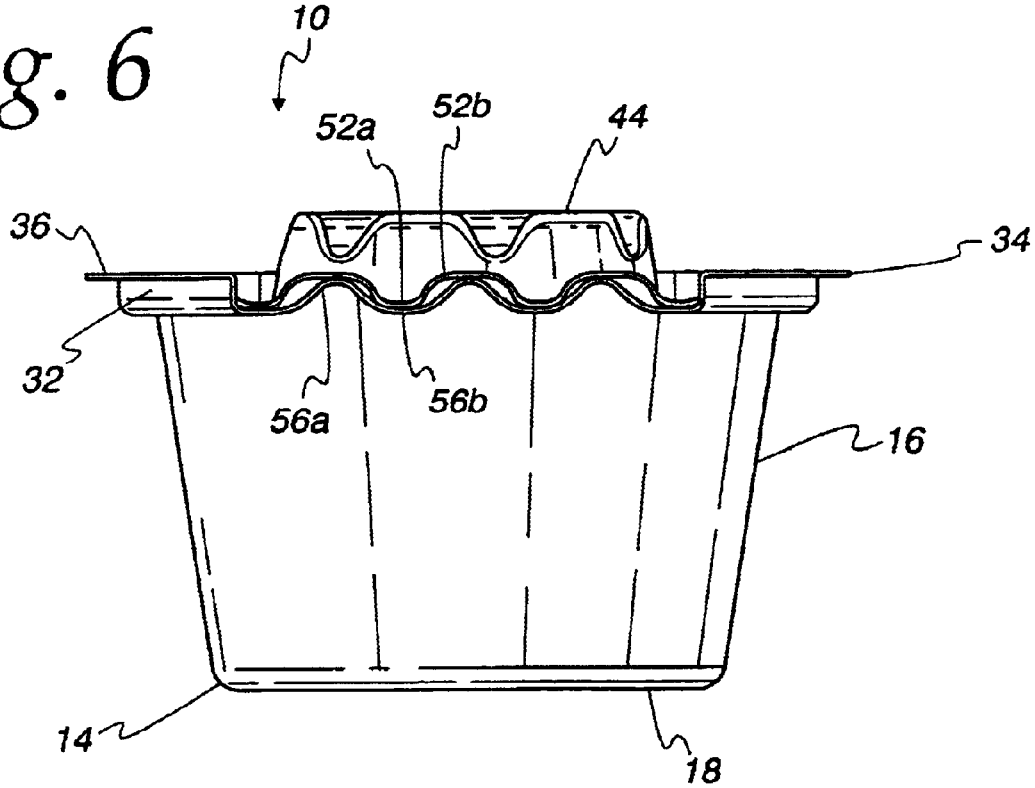
FIG. 6 is a side elevational view of the food package of FIG. 2, shown partly cut away along the line 6—6 of FIG. 2.

Turning now to FIGS. 4 and 5, bowl 14 includes a recessed rim 32 having an outwardly extending flange 34 with an upper surface 36 (see FIG. 1) for conveniently receiving a sealing film 38 made for example of plastic or aluminum foil. Sealing film 38 cooperates with bowl 14 to completely enclose food products 24, 28 as well as the entire portion of cap 12 and the interior of bowl 14. If desired, sealing film 38 could be replaced with other packaging components known in the art to cooperate with bowl 14 to seal the contents thereof.

Figure 7:
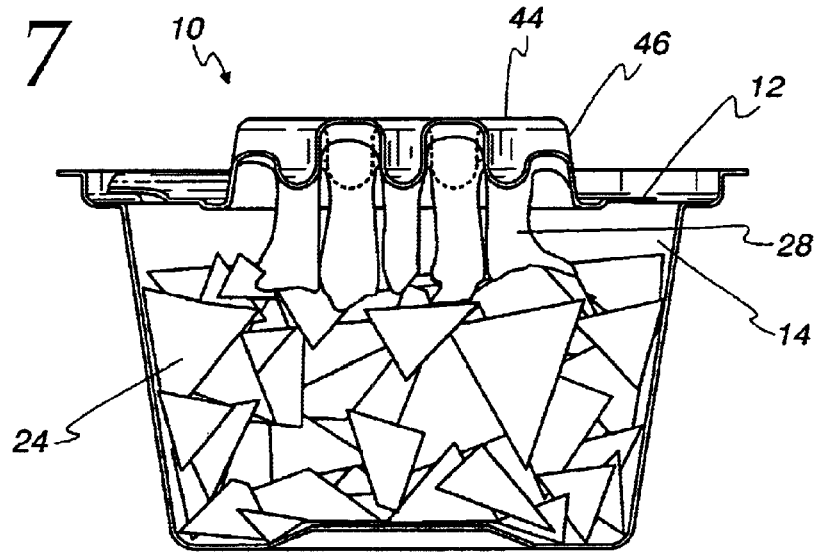
FIG. 7 is a cross-sectional view taken along the line 7—7 of FIG. 2.
Figure 8:
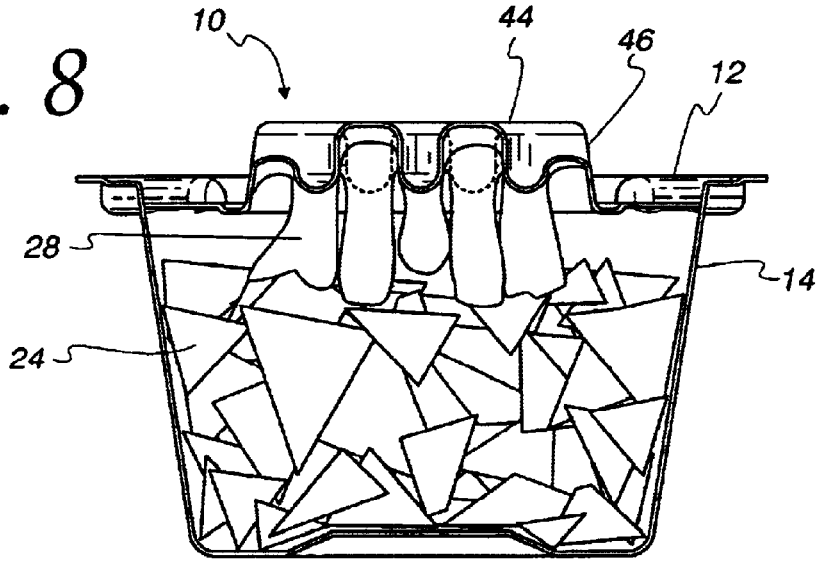
FIG. 8 is a cross-sectional view taken along the line 8—8 of FIG. 2.

As shown in FIGS. 1 and 3–5, package 10 is configured for shipment, whereas FIGS. 2 and 6–8 show package 10 configured for heating which releases the second food component 28 for contact with the first food component 24, as illustrated in FIGS. 7 and 8. Cap 12 has a first side illustrated in FIG. 1 with a central recess portion 40. A plurality of separate spaced apart protrusions 42 extend above an end wall 44 as can be seen for example in FIG. 4. End wall 44 is joined to a frustoconical side wall 46 so as to receive support from a truncated circular outer wall portion 48.

Figure 1:
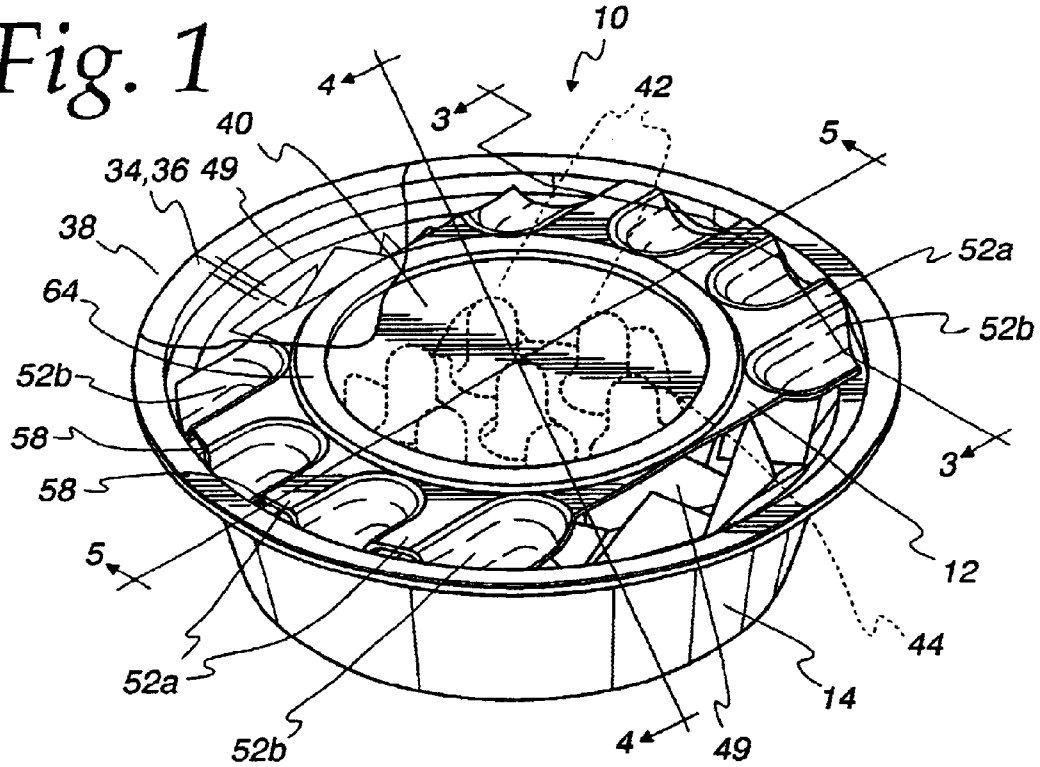
FIG. 1 is a perspective view of a food package prepared for shipment.
Figure 2:
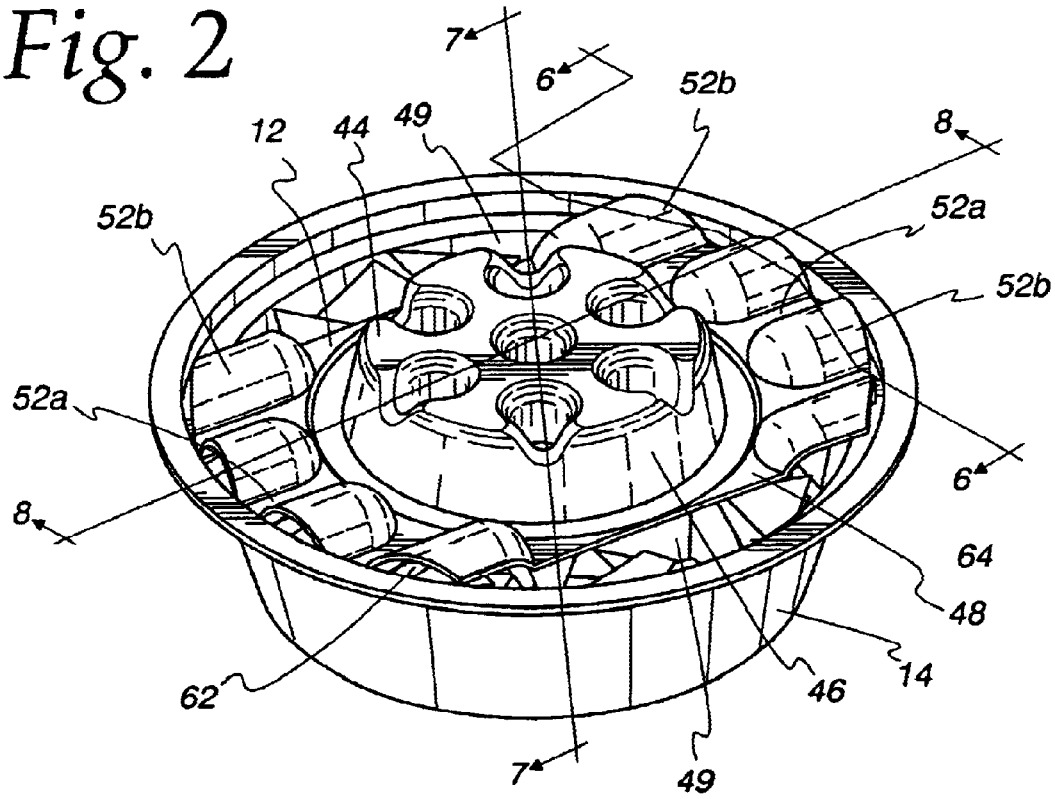
FIG. 2 is a perspective view of the food package being prepared for heating.

The truncations in wall portion 48 form segment shaped openings 49 (see FIGS. 1 and 2). In this manner, cost effective conventional mass production gas-flushing techniques can be applied to package 10 immediately prior to the application of sealing film 38. The gas-flushing may be employed, for example, to preserve the freshness, crispness, flavor and other desirable perishable qualities of the food components 24.

In the storage position illustrated in FIG. 4, the outer wall portion is nested within recess 32 and is generally coextensive with the outer marginal portion 34 of bowl 14. The nested arrangement provides a stable well-sealed arrangement for the readily application of sealing film 38. The application of sealing film 38, as with the filling of food product components 24, 28 and the assembly of cap and bowl portions, is well suited for high speed mass production techniques.

Figure 3:
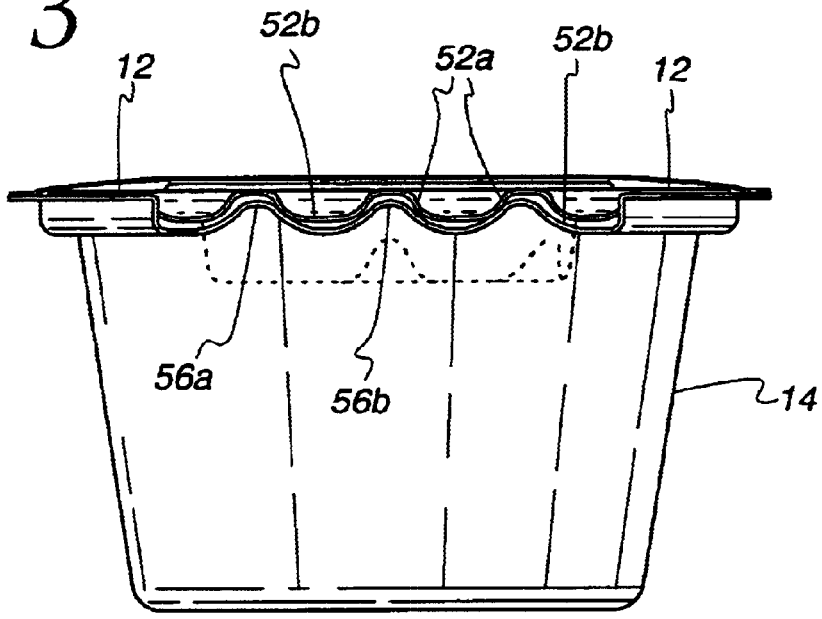
FIG. 3 is a side elevational view of the food package of FIG. 1.

Referring to FIGS. 1 and 2, cap 12 includes a pair of diametrically opposed fluted portions 52 having first narrower parts 52*a* and second, wider parts 52*b*. Bowl 14 has diametrically opposed fluted portions 56 generally coextensive with the fluted portions 52 of cap 12. The fluted portions 56 of bowl 14 include first narrower parts 56*a* and second wider parts 56*b*. As shown in FIG. 3 fluted portions 52, 56 of cap 12 and bowl 14 nest within one another with the narrow parts 52*a*, 56*a* adjacent one another and the wider parts 52*b*, 56*b* adjacent one another.

Referring to FIG. 2, with cap 12 in the inverted, heating position, the openings 49 and the cooperating fluted portions of cap 12 and bowl 14 provide passageways for the escape of steam through exit openings 62. As can be seen in FIG. 2, end wall 44 and trapezoidal side wall 46 form a cup portion which, when inverted in the manner shown in FIG. 4, for example, can conveniently receive a liquified second food component 28. Preferably, the second food component 28 is allowed to harden to form a cake contained within end wall 44 and side wall 46, being interrupted by protrusions 42. Preferably, as indicated in FIG. 4, second food component 28 is filled slightly above the free ends of projections 42.

In the preferred embodiment shown in FIGS. 1 and 2, for example, projections 42 include a central protrusion 42 surrounded by a plurality of equally spaced protrusions arranged in a circular pattern. Other arrangements of protrusions, and arrangements including differing number of protrusions are also contemplated by the present invention. As illustrated in the enlarged cross-sectional view of FIG. 9, projections 42 are preferably continuously rounded and include a rounded free end. In a preferred embodiment, the rounded free end of projection 42 is generally hemispherical in shape, although other shapes could be employed, as well.

In use, a consumer removes the film seal 38 or other conventional seal for bowl 14, exposing the cake of second food component 28. If desired, the cake of second food product component 28 could be separately sealed with a peel seal of appropriate material such as plastic film or aluminum foil and an outer flat band 64 (see FIGS. 1 and 2) is made available for this purpose. As will be appreciated by those skilled in the art, the application of seal 38 to the upper end of package 10, in the manner indicated can be readily accomplished using conventional equipment and mass production assembly techniques.

Upon removing the seal 38, the user accesses cap 12, inverting the cap to the position indicated in FIGS. 2 and 6–8 with the cake of second food product 28 facing in a downward direction, into the interior of bowl 14. The cake is then subjected to conditions which cause the second food product to take on a liquified form. Preferably, the cake 28 is heated, causing it's outer surface to become liquified and drip onto the first food product component 24 in the manner indicated in FIGS. 7 and 8. The protrusions 42 guide the liquified second food product component in a desired dispersion pattern, insuring a uniform coating of the first food product component 24 about the second food product component 28.

The protrusions 42, in cooperation with other features of the illustrated embodiment, have been found to satisfactorily distribute the second food product component in a uniform manner across the interior of bowl 14, and have further been found to release the substantial entirety of the second food product component in the desired manner. As an important feature, a single release of the entire second food product component into the interior of bowl 14 is prevented.

Figure 9:
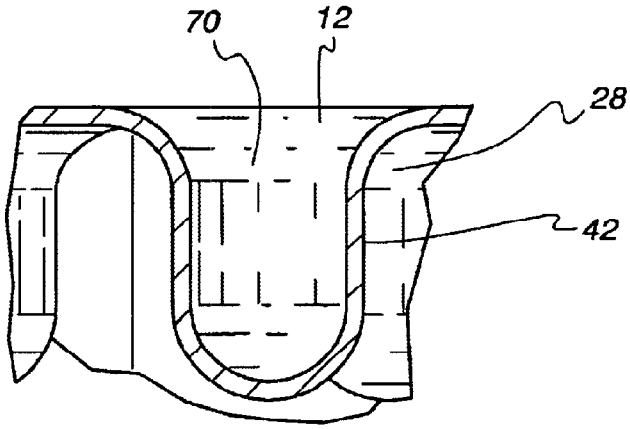
FIG. 9 is an enlarged fragmentary view of the lid portion thereof.

It is believed that retention of the cake of the second food product component during heating is facilitated by surface tension of the product with the protrusions formed by the hollow interior of protrusions 42, visible for example in FIG. 2. It is generally preferred, for this reason, and for reasons of economical plastic molding that the protrusions 42 be made hollow in the manner illustrated. Referring to FIG. 9, for example, the hollow cavities 70 of protrusions 42 could be conveniently filled with a cooling medium such as ice water or could be made solid, to provide a thermal heat sink mass, although such has been found to be unnecessary. In addition to the thermal functioning of cap 12 during heating, the number and relatively close spacing of protrusions 42, as well as their relative proportions shown for example in FIG. 9 are believed to contribute to the controlled release of second food product 28.

In the preferred embodiment, as mentioned, first food product component 24 comprises vegetable chips, and most preferably tortilla chips. Also, in the preferred embodiment second food product component 28 comprises a cheese sauce having the following characteristic properties.

It is generally preferred that the second food product component be semi-viscous during manufacturing so as to be compatible with mass production filling and assembling techniques. As mentioned, it is generally preferred that the package configuration shown in FIG. 1 be assembled in high speed production environment, allowing assembly and filling of both food product components immediately prior to application of sealing film 38. Alternatively, further advantages of the present invention can be realized with the separate assembly of cap 12 and second food product component 28. For example, the second food product component can be filled in a liquified or semi-viscous state caused for example by heating the second food product component. Caps can be filled in a high speed production environment and introduced into a refrigerated or cooling environment to promote rapid solidification of the second food product component, rendering the assembly less sensitive to non-refrigerated mass production assembly techniques employed to produce package 10.

In the preferred embodiment, the second food product component 28 forms a cake approximately 3" in diameter and approximately 0.6" in height. The protrusions 42 have a maximum diameter of approximately 0.44" and a height or axial length slightly less than the 0.6" thickness of cake 28. The opposed fluted portions of cap 12 each have a width of approximately 2.5", with band 64 having a diameter of approximately 3.25" and frustoconical wall 46 having a maximum diameter of approximately 2.9".

As mentioned, aspects of the preferred embodiment provides packaging for the combination of a cheese sauce and a tortilla chip component, although other combinations of secondary and primary food components can receive the benefits of food package 10 and the assembly and filling techniques employed therewith. For purposes of suggestion, but not limitation, the secondary/primary food component compositions can comprise: cheese sauce over nacho chips, cheese sauce over pretzels, chocolate sauce over one or more brownie cookies, cinnamon frosting over one or more rolls or other bread products, salsa sauce over nacho chips and cheese sauce over popcorn.

Figure 10:
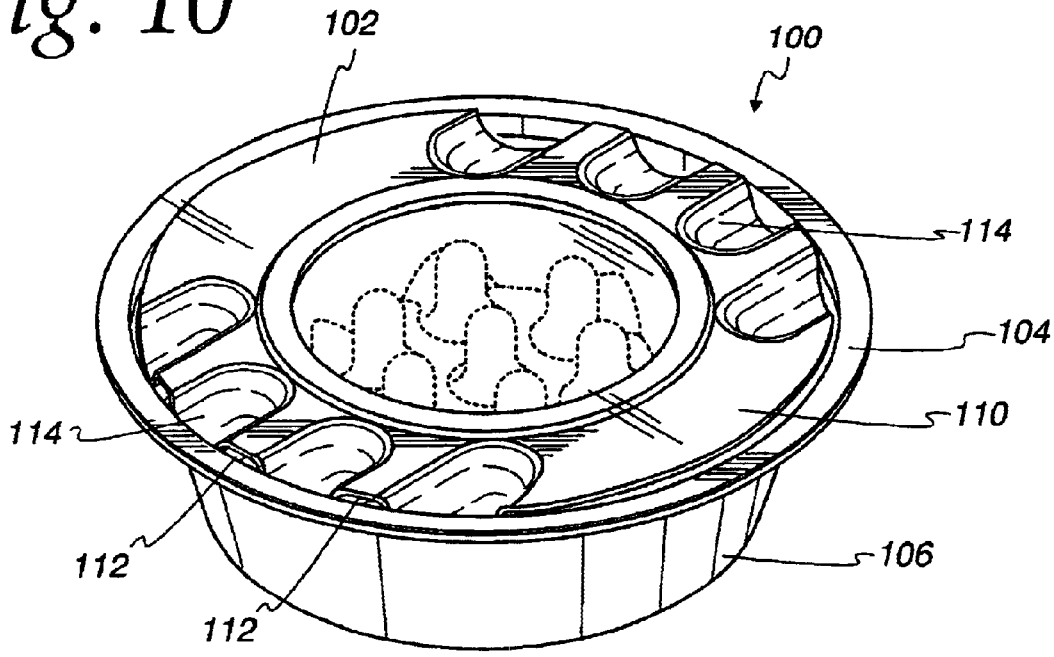
FIG. 10 is a perspective view of an alternative food package, shown ready for shipment.
Figure 11:
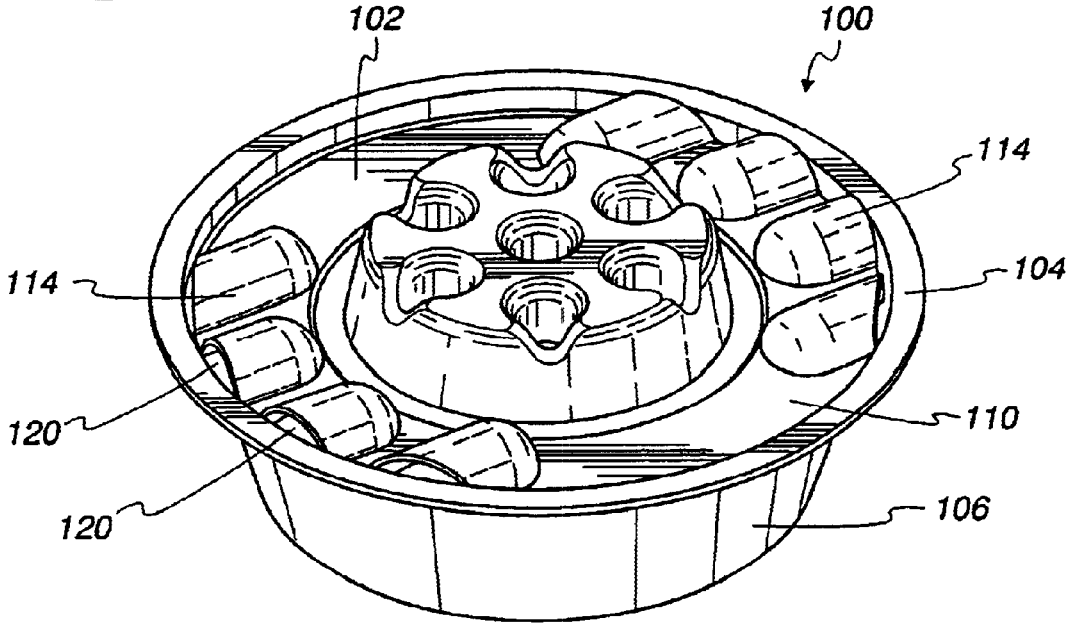
FIG. 11 is a perspective view of the food package of FIG. 10 shown prepared for heating.

Turning now to FIGS. 10 and 11, an alternative embodiment of a food package is indicated at 100. FIG. 10 shows food package 100 being readied for shipment to a consumer. A plastic overwrap 102 is applied to the upper end of the food package and is sealed to the flange 104 of cup or bowl 106. The cap 110 of food package 100 has a generally continuous circular outer periphery and covers substantially the entire circular opening defined by flange 104. Food package 100 is substantially identical to the food package 10, described above, except that cap 110 provides a continuous cover for the upper end for bowl 106.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A combination of a package assembly and a liquefiable first food component, assembled for transport to a remote location, comprising:

a bowl having a side wall and a bottom wall cooperating to define an interior cavity for containing a second food component, and an upper end;

a lid dimensioned to fit within the upper end of the bowl, said lid having a central cup-like depression and a plurality of protrusions extending from the bottom of the cup-like depression;

said liquifiable first food component, in cake form, contained in said cup-like depression and in contact with said protrusions;

said lid being movable from a shipping and storage position fitted in the upper end of the bowl wherein the center cup-like depression opens upwardly to an inverted cooking or heating position wherein said lid is fitted in the upper end of the bowl wherein the center cup-like depression opens downwardly into the bowl and the plurality of protrusions are directed downwardly away from the bottom of the cup-like depression;

said lid fitting within the upper end of said bowl leave a sufficient portion of said interior cavity for containing said second food component which second food component is to be associated with said first food component for consumption;

the lid including a pair of diametrically opposed fluted portions disposed on either side of the central cup-like depression;

the bowl defining a pair of diametrically opposed fluted portions, complementary shaped to the fluted portions of the lid so that the lid and the bowl cooperate for nested interfitting with the lid in the bowl in both shipping and storage position and inverted cooking or heating position;

said protrusions being dimensioned, shaped and arranged such that when said second food component is placed in the interior of said bowl and said lid placed in its inverted position in the upper end of the bowl and the cake of said first food component is subjected to conditions which cause the fast food component to be liquified, said protrusions guide said first food component in a dispersion pattern for substantially uniform distribution onto said second food product.

2. The combination of claim 1 wherein the second food component comprises a farinaceous food product.

3. The combination of claim 2 wherein the first food component comprises a cheese sauce.

4. The combination of claim 1 wherein said protrusions have continuously rounded outer surfaces.

5. The combination of claim 1 wherein a plurality of said protrusions are arranged in a circular pattern disposed about a central protrusion.

6. The combination of claim 1 wherein the fluted portions of at least one of said lid and said bowl comprise an alternating series of a first narrower fluted part and a second wider fluted part.

7. The combination of claim 1 wherein the bottom of the bowl has a central raised portion forming an outer recessed ring in the bowl interior.

8. The combination of claim 1 further comprising a sealing membrane covering the lid and bowl.

9. The combination of claim 8 wherein the bowl includes an outwardly depending flange at its upper end presenting a flat surface for contact with the sealing membrane.

10. The combination of claim 9 wherein the sealing membrane comprises a plastic film.

11. The combination of claim 9 wherein the sealing membrane comprises aluminum foil.

12. The combination of claim 1 wherein, with the lid in the shipping and storage position, the lid is supported by the fluted portions of the bowl so as to suspend the lid substantially entirely within the bowl.

13. The combination of claim 1 wherein the fluted portions of the bowl cooperate with the fluted portions of the lid in the shipping and storage position so as to form a plurality of passageways communicating with the bowl interior for gas flushing of the bowl interior.

14. The combination of claim 1 wherein the fluted portions of the bowl cooperates with the fluted portions of the lid in the cooking or heating position so as to form passageways communicating with the bowl interior so as to vent pressure formed in the bowl interior during heating.

15. The combination of claim 1 wherein the lid has a part circular shape, with diametrically opposed portions removed so as to form openings when the lid is fitted within the upper end of the bowl.

16. The combination of claim 1 wherein the lid has a generally circular shape with a circular outer periphery.

* * * * *

UNITED STATES PATENT AND TRADEMARK OFFICE

CERTIFICATE OF CORRECTION

PATENT NO. : 6,645,539 B2
DATED : November 11, 2003
INVENTOR(S) : Bukowski et al.

It is certified that error appears in the above-identified patent and that said Letters Patent is hereby corrected as shown below:

Column 5,
Line 62, change “liquefiable,” to -- liquifiable --.

Column 6,
Line 17, after “bowl”, insert -- to --.

Signed and Sealed this

Thirtieth Day of March, 2004

JON W. DUDAS
*Acting Director of the United States Patent and Trademark Office*